US010060278B2

(12) United States Patent
Boeck

(10) Patent No.: US 10,060,278 B2
(45) Date of Patent: Aug. 28, 2018

(54) GUIDE VANE FOR A TURBOMACHINE HAVING A SEALING DEVICE; STATOR, AS WELL AS TURBOMACHINE

(71) Applicant: MTU Aero Engines AG, Munich (DE)

(72) Inventor: Alexander Boeck, Kottgeisering (DE)

(73) Assignee: MTU Aero Engines AG, Munich (DE)

( * ) Notice: Subject to any disclaimer, the term of this patent is extended or adjusted under 35 U.S.C. 154(b) by 313 days.

(21) Appl. No.: 14/539,434

(22) Filed: Nov. 12, 2014

(65) Prior Publication Data

US 2015/0192025 A1 Jul. 9, 2015

(30) Foreign Application Priority Data

Nov. 12, 2013 (DE) ..... 10 2013 222 980

(51) Int. Cl.
*F01D 11/00* (2006.01)
*F01D 9/04* (2006.01)
*F01D 17/16* (2006.01)

(52) U.S. Cl.
CPC ..... *F01D 11/001* (2013.01); *F01D 9/04* (2013.01); *F01D 9/041* (2013.01); *F01D 9/042* (2013.01); *F01D 11/00* (2013.01); *F01D 11/005* (2013.01); *F01D 17/162* (2013.01)

(58) Field of Classification Search
CPC ..... F01D 11/008; F01D 11/005; F01D 9/04; F01D 9/041; F01D 9/042; F01D 11/00; F01D 11/001; F01D 17/162; F05D 2240/80
See application file for complete search history.

(56) References Cited

U.S. PATENT DOCUMENTS 3,367,628 A 2/1968 Fitton
3,938,906 A * 2/1976 Michel ..... F01D 11/005 415/139
4,950,129 A * 8/1990 Patel ..... F01D 5/26 415/148
5,129,783 A 7/1992 Hayton
5,636,968 A * 6/1997 Audet ..... F01D 17/162 415/160
7,588,416 B2 * 9/2009 Bouru ..... F01D 17/162 415/160
8,511,972 B2 * 8/2013 Sutcu ..... F01D 9/023 277/644
8,721,269 B2 5/2014 Abadie et al.
(Continued)

FOREIGN PATENT DOCUMENTS

DE 1576987 5/1970
DE 3429641 6/1985
(Continued)

*Primary Examiner* — Logan Kraft
*Assistant Examiner* — Danielle M Christensen
(74) *Attorney, Agent, or Firm* — Davidson, Davidson & Kappel, LLC

(57) ABSTRACT

A guide vane (300) for a turbomachine, having a sealing device (27, 27') at the radially inner end region of the guide vane (300) for sealing leakage flows (25) between the guide vane (300) and an inner ring (7) joined thereto. The sealing device (27, 27') is movably configured relative to the guide vane (300). The sealing device (27, 27') is positionable in at least one open or in a closed configuration for sealing the leakage flows (25). Also, a guide vane (100), as well as a turbomachine.

21 Claims, 13 Drawing Sheets

(56) References Cited

U.S. PATENT DOCUMENTS

| | | | |
|---|---|---|---|
| 2011/0158793 | A1 | 6/2011 | Fritsch et al. |
| 2013/0205800 | A1 | 8/2013 | Ivakitch et al. |
| 2013/0216361 | A1* | 8/2013 | Propheter-Hinckley ..... F01D 17/162 415/160 |

FOREIGN PATENT DOCUMENTS

| | | |
|---|---|---|
| DE | 10 2004 050 739 | 4/2006 |
| FR | 2652383 | 3/1991 |
| GB | 2151309 | 7/1985 |
| GB | 2234299 | 1/1991 |
| WO | WO09841735 | 9/1998 |
| WO | WO2010/079204 | 7/2010 |
| WO | WO2012092543 | 7/2012 |

* cited by examiner

GUIDE VANE FOR A TURBOMACHINE HAVING A SEALING DEVICE; STATOR, AS WELL AS TURBOMACHINE

This claims the benefit of German Patent Application DE 10 2013 222 980.1, filed Nov. 12, 2013 and hereby incorporated by reference herein.

The present invention relates to a guide vane for a turbomachine having a sealing device at the radially inner end region of the guide vane. The present invention also relates to a stator, as well as to a turbomachine.

BACKGROUND

In turbomachines, efficiency is influenced by various factors and parameters. In particular, efficiency is reduced by flow losses resulting from bypass flows outside of the main flow through the rotor blading and stator blading. There are different ways to at least reduce such bypass flows in order to avoid efficiency losses. For example, seals are configured on vane assemblies of the turbomachine in order to reduce bypass flows.

SUMMARY OF THE INVENTION

It is an object of the present invention to provide a further guide vane for a turbomachine that is designed for a sealing device at the radially inner end region of the guide vane for sealing leakage flows between the guide vane and an inner ring joined thereto. It is also an object of the present invention to provide an appropriate stator, as well as a turbomachine.

The present invention provides a sealing device that is movably configured relative to the guide vane. The sealing device is positionable in at least one open or in a closed configuration for sealing the leakage flows.

The stator according to the present invention has at least one guide vane according to the present invention. The stator may be a section of a compressor stage. The stator may be referred to as a guide vane wheel.

The turbomachine according to the present invention has at least one stator according to the present invention. The turbomachine may be a gas turbine or an aircraft engine.

In all of the explanations above and in the following, the expressions "may be," respectively "may have" etc. are synonymous with "is preferably," respectively "has preferably" etc. and are intended to clarify specific embodiments according to the present invention.

Whenever numerical words are mentioned herein, one skilled in the art understands these to indicate a numerically lower limit. Provided that this does not lead to a contradiction that one skilled in the art can recognize, he/she always reads "at least one" when "one" is indicated, for example. This understanding is likewise included in the present invention, as is the interpretation whereby a numerical word such as "one," for example, may alternatively mean "exactly one," wherever one skilled in the art recognizes this as being technically feasible. Both are included in the present invention and apply to all of the numerical words used herein.

Inventive specific embodiments may include one or more of the features mentioned in the following.

In some of the specific embodiments according to the present invention, the turbomachine is an axial turbomachine, in particular a gas turbine. The gas turbine may be an aircraft engine.

In many specific embodiments according to the present invention, the guide vane is a guide vane of a compressor stage, for example, of a low-pressure compressor stage and/or of a high-pressure compressor stage.

In certain specific embodiments according to the present invention, a plurality of guide vanes configured in the circumferential direction of the turbomachine are joined to the inner ring. The guide vanes and the inner ring joined thereto may be referred to as guide vane ring or stator or stator rim.

In some of the specific embodiments according to the present invention, the inner ring is designed and configured for being joined to a seal carrier. The connection, in particular, has a detachable design, such as that provided by a tongue and groove connection. For example, the inner ring has a groove or a collar onto which the guide vane ring of the seal carriers is slid circumferentially.

In certain specific embodiments according to the present invention, the sealing device is configured, positioned or supported translationally and/or rotationally (rotatably) relative to the guide vane. In particular, the sealing device is movable in a direction orthogonally to the longitudinal axis of the guide vane. The sealing device is movable at the radially inner end region of the guide vane in the region of a guide vane platform, for example, in order to at least reduce a leakage flow.

In certain specific embodiments according to the present invention, the sealing device is positioned in an open configuration, "open configuration" signifying an opened or open flow cross section of a leakage flow that is not or is at least not completely sealed by the sealing device in this configuration. This position may be described as an installation position. In the installation position, the sealing device is not or not yet positioned in a manner that makes it possible to seal or reduce the leakage flow. Only after moving (translationally and/or rotationally) out of this installation position is a leakage flow effectively at least partially reduced.

In some specific embodiments according to the present invention, the sealing device is positioned in a closed configuration for sealing the leakage flows. In the closed configuration, the sealing device or a portion thereof at least partially seals a flow cross section of a leakage flow.

In many specific embodiments according to the present invention, the location or the position of the sealing device in the closed configuration is referred to as the hook position. In the hook position, the sealing device may be moved or displaced until it rests against one or a plurality of hooks acting as a limit stop. The hook may be referred to as a stop hook. In the hook position, the sealing device is able to seal a gap or an area of a flow cross section of a leakage flow. In the hook position, the sealing device may advantageously at least reduce the leakage flow.

In some of the specific embodiments according to the present invention, the stop hook limits the displacement path of the sealing device. The stop hook may be referred to as a securing hook. It may likewise limit rotations of the sealing device. The center of rotation for limiting the rotational movement of the sealing device may reside within or outside of the sealing device. In other words, the sealing device may rotate about the center of rotation of the stop hook(s).

In certain specific embodiments according to the present invention, the sealing device or portions thereof is/are moved by the leakage flow. For example, the flow pressure of the leakage flow may be great enough to change the position of the sealing device. This movement of the sealing device may be referred to as pressure-controlled movement.

The sealing device or at least a portion thereof may be moved solely by the leakage flow.

In certain specific embodiments according to the present invention, the guide vane is rotatably mounted about a longitudinal axis thereof. In particular, the radially inner and/or outer ends of the guide vanes are provided with projections or pivot pins within which or about which the guide vanes rotate. The radially outer pivot pin may be referred to as outer pivot pin; the radially inner pivot pin as inner pivot pin.

In some specific embodiments according to the present invention, the inner pivot pin may be configured or guided in the inner ring. Configured in the inner ring, in particular, are bushings, for example bearing bushings, in which the guide vanes rotate.

The rotation angle of the guide vanes about the longitudinal axis thereof may be referred to as adjustment angle.

In many specific embodiments according to the present invention, the sealing device is a plate or a slide plate.

In particular, the sealing device is fabricated of metal or features metal.

In certain specific embodiments according to the present invention, the sealing device has a bore or a through bore for allowing throughflow of at least a portion of the leakage flow. The bore is configured, in particular, perpendicularly to the surface of the slide plate. The slide plate may be moved in the guide vane by the bore and a pressurized leakage flow. In particular, the slide plate is moved from the installation position into the closed position, or hook position.

In certain specific embodiments according to the present invention, the sealing device and/or the guide vane have/has at least two stop hooks. Relative to a central axis of the sealing device, the stop hooks may be configured asymmetrically in one displacement direction of the sealing device. The stop hook geometry may be configured and optimized in a way that allows all possible positions of the sealing device, including possible limit positions, to prevent the sealing device from becoming jammed in the guide vane.

In some of the specific embodiments according to the present invention, the sealing device is configured in a pocket shape in a guide vane platform.

In many specific embodiments according to the present invention, the guide vane and/or the sealing device are/is produced using an additive manufacturing process. The additive manufacturing process may be a selective laser melting process (selective laser melting—SLM).

Many or all of the specific embodiments according to the present invention may feature one, a plurality of, or all of the advantages mentioned above and/or in the following.

Using the guide vane according to the present invention, it is at least advantageously possible to reduce the leakage flow in the connection region between the guide vane and the inner ring that, in particular, is joined to a seal carrier in a stator. By reducing the leakage flow, it is possible to increase the efficiency of a turbomachine in which the stator is installed. The seal carrier may have an abradable seal or be joined thereto.

The guide vane according to the present invention makes it advantageously possible to at least reduce the influence of the flow in the adjacent guide vanes in a stator in the installed state, in that the leakage flow is at least reduced in the connection region between the guide vane and the inner ring. Reducing the extent to which the flow is influenced, in particular the flow incident to the leading edge of adjacent guide vanes, may lead to an improvement in the flow around adjacent guide vanes and thus improve the efficiency of the flow around the guide vanes. Reducing the influence of the flow of adjacent guide vanes in the installed state may enhance the pump stability of a compressor stage in which the stator may be installed.

The guide vane according to the present invention and/or the sealing device according to the present invention may be advantageously produced inexpensively using an additive manufacturing process, in particular by selective laser melting.

BRIEF DESCRIPTION OF THE DRAWINGS

The present invention is explained exemplarily in the following with reference to the accompanying drawings, in which identical reference numerals denote like or similar components. It holds for each of the schematically simplified figures that.

DETAILED DESCRIPTION

Figure 1:
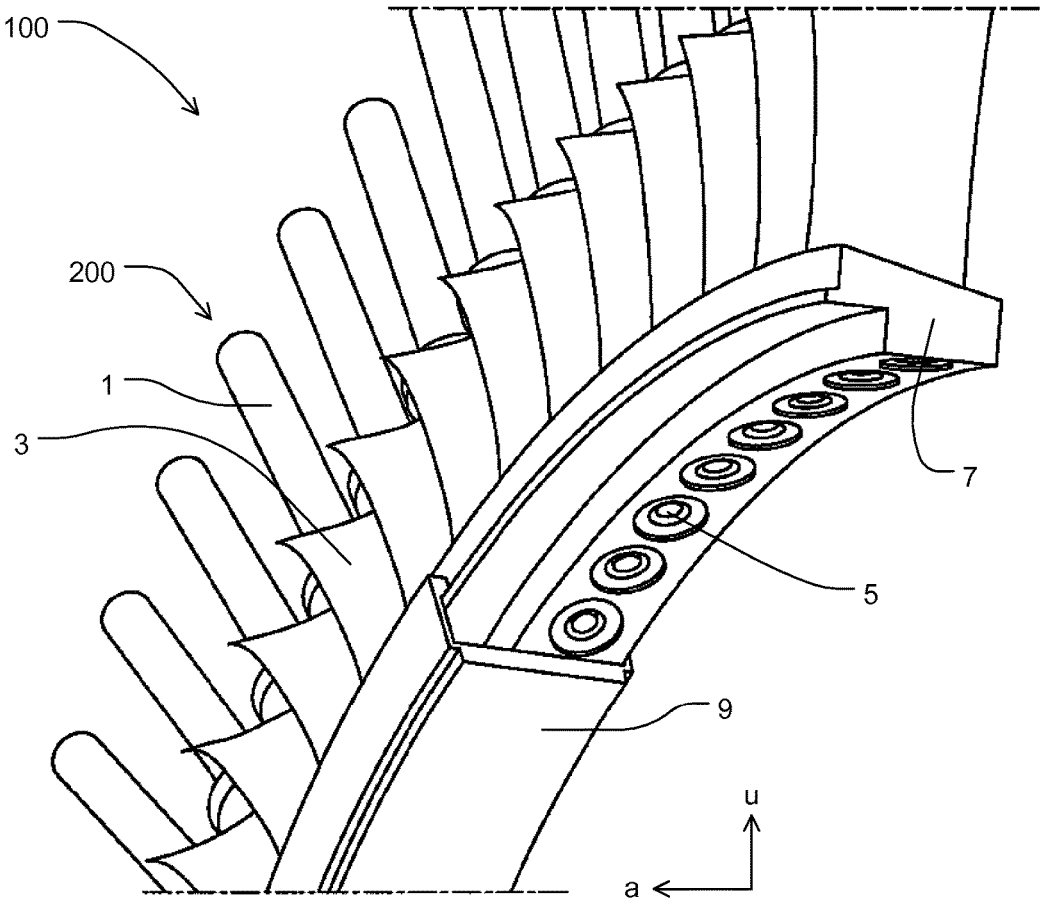
FIG. 1 shows a detail of a stator rim according to the related art.

FIG. 1 shows a detail of a stator rim 100 in a perspective view according to the related art.

Stator rim 100 has a plurality of guide vanes 200 that are disposed side-by-side in circumferential direction u. Guide vanes 200 each have outer pivot pins 1 that are joined at the radially outer end to a casing of a turbomachine (not shown in FIG. 1), in particular of a gas turbine. The radially inner end of outer pivot pins 1 is joined to guide vane profiles 3.

Figure 2:
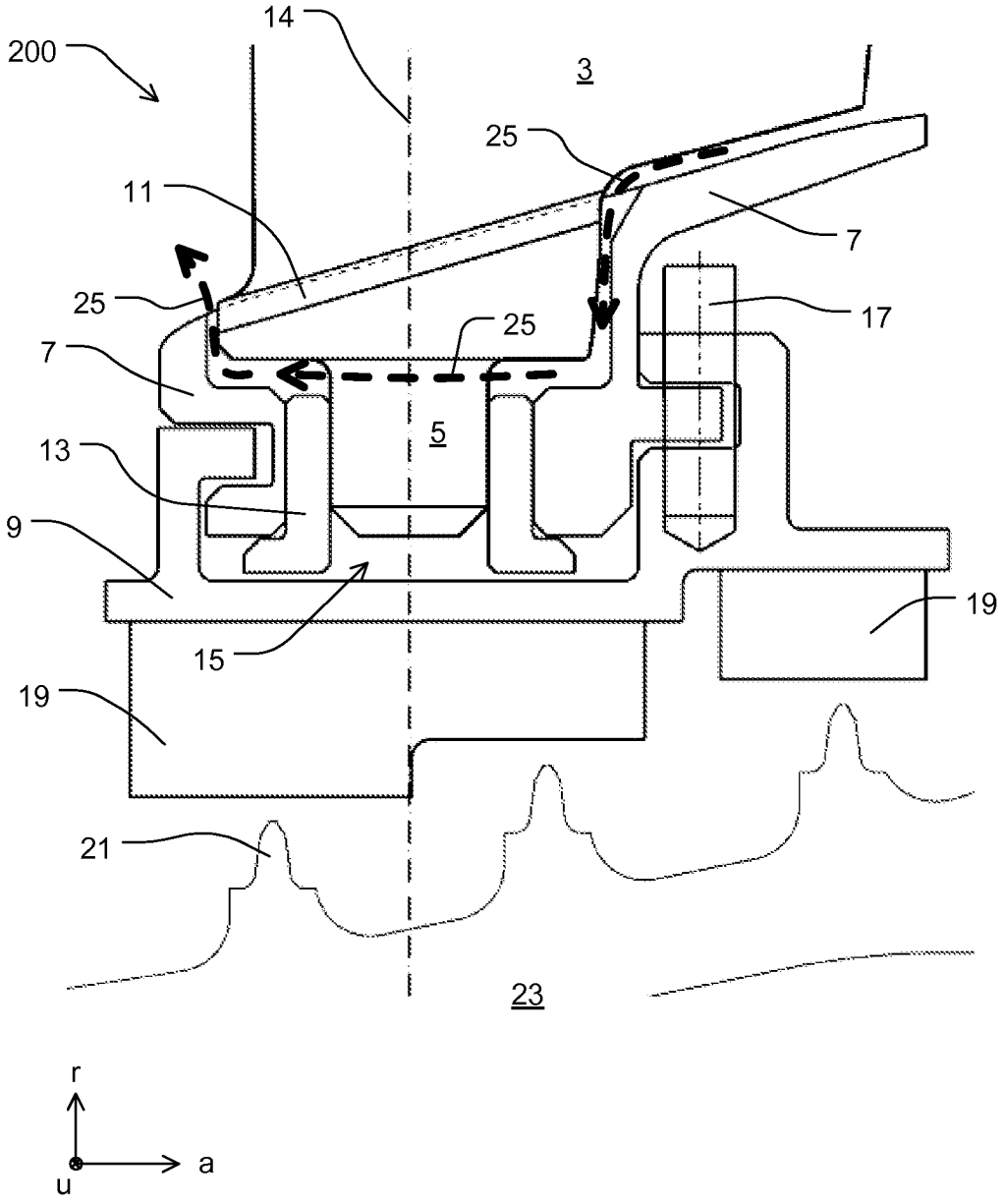
FIG. 2 shows a leakage flow between a guide vane platform and an inner ring of the related art.

The radially inner ends of guide vane profiles 3 are connected by pins 5 (respectively pivot pins) to an inner ring 7 of stator rim 100 (see FIG. 2). Inner ring 7 is connected to an annular seal carrier 9.

Inner ring 7 and seal carrier 9 are subdivided in particular into two semicircular segments that are slid into one another circumferentially.

Seal carrier 9 may be joined to abradable seals or abradable sealing segments.

FIG. 2 shows a detail from FIG. 1 in a sectional view including a guide vane platform 11 and inner ring 7 according to the related art.

Guide vane 200 is connected to inner ring 7 via pin 5 and a bushing 13. Bushing 13 is additionally inserted into a bore 15 of inner ring 7 to fix pin 5 in inner ring 7 and/or is used as a bearing bushing for rotations of guide vanes 200 about a longitudinal axis 14.

Seal carrier 9 and inner ring 7, which are both designed as semicircular segments, in particular, may both be slid into one another in circumferential direction u. In the installed state, the segments are secured (relative to one another) by a securing pin 17 against a displacement of seal carrier 9 and inner ring 7.

Joined to seal carrier 9 are abradable seals 19 that are provided for forming a sealing gap between sealing peaks 21, for example of a rotating shaft 23. Abradable seals 19 are designed, in particular, to be segmented over the circumference.

In accordance with the related art, a leakage flow 25 forms, in particular, between guide vane platform 11 and inner ring 7. In response to the pressure differential, leakage flow 25 flows from the pressure side of the vane profile to the suction side.

Figure 3:
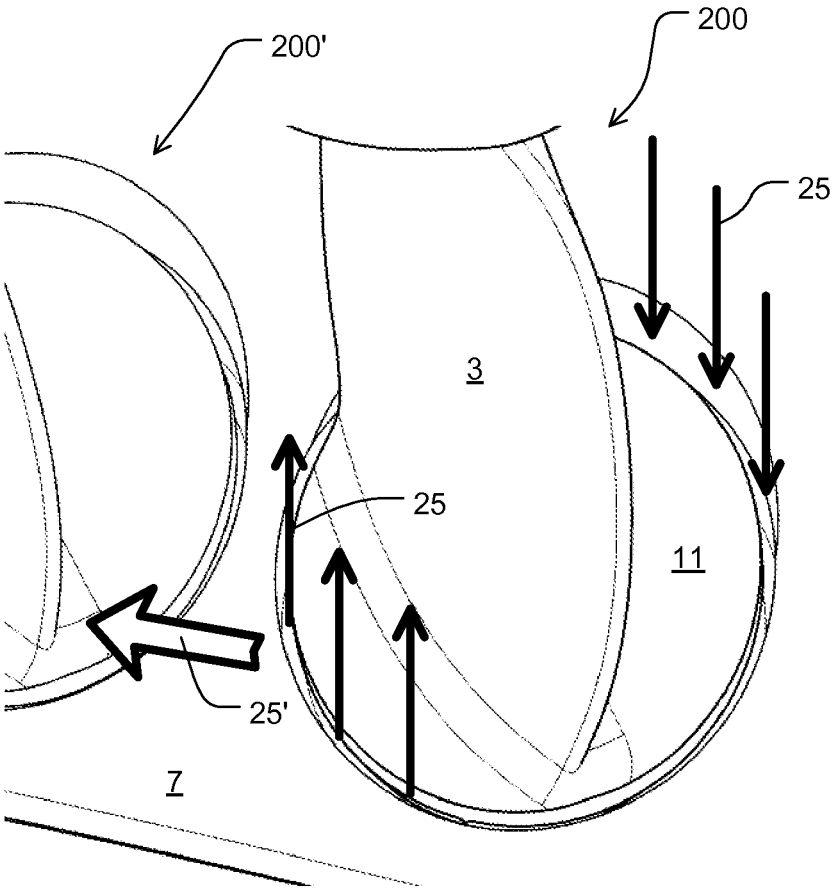
FIG. 3 shows the leakage flow from FIG. 2 in a perspective view including an adjacent guide vane according to the related art.

FIG. 3 shows leakage flow 25 from FIG. 2 in a perspective view including an adjacent guide vane 200' according to the related art.

A portion of leakage flow 25' (leakage flow 25' may be described as an air jet) may flow from leakage flow 25 of guide vane 200 emerging between guide vane platform 11 and inner ring 7, in the direction of incident flow edge of adjacent guide vanes 200' and thus disturb the airflow incident to guide vanes 200'. This may lead to efficiency losses.

Figure 4A:
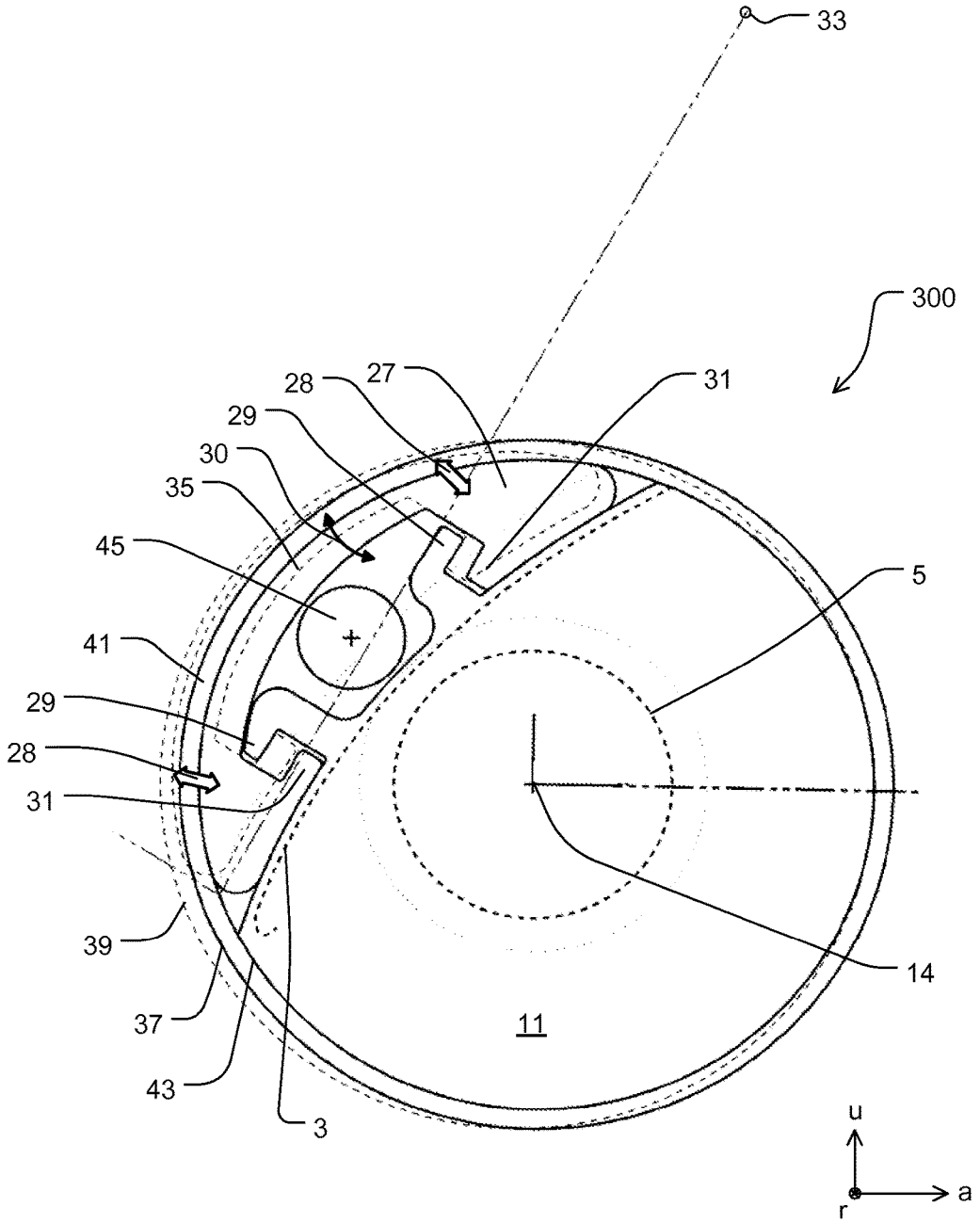
FIGS. 4*a, b, c* show a guide vane according to the present invention including a sealing device and two stop hooks on the guide vane.

In one plane having the axes circumferential direction u and axial direction a, orthogonally to radial direction r, FIG. 4*a* shows a sectional view of a guide vane 300 according to the present invention having a sealing device 27 and two stop hooks 29 that are connected to guide vane 300. The sectional view of FIG. 4*a* is disposed approximately in the center in radial direction r at the level of guide vane platform 11 (see FIG. 6).

Guide vane profile 3 (see FIG. 6) is not visible in this sectional plane, but is sketched in dashed lines to illustrate the configuration of sealing device 27. Pin 5 (disposed radially inwardly relative to guide vane platform 11) is likewise shown in dashed lines since it is not visible in this sectional view. Pin 5 is shown, for example, in FIGS. 6*a* and 5*b*.

In this exemplary embodiment, the sealing device is designed as a slide plate 27. In the sectional plane shown in FIG. 4*a*, slide plate 27 may move in circumferential direction u and in axial direction a (displacement path 28), not, however, in radial direction r (see FIG. 6). The movement is limited by both stop hooks 29 against which both offsets 31 of slide plate 27 may rest.

The position of slide plate 27 shown in FIG. 4*a* may be referred to as installation position.

Slide plate 27 may rotate within the described freedom of movement about a center of rotation 33 of stop hooks 29 with a rotation angle 30.

In a dashed representation, slide plate 27 is shown in a hook position 35. In hook position 35, the maximum displacement path of slide plate 27 is reached relative to the initial position (installation position).

Circle 37 represents bore 37 in inner ring 7 for accommodating guide vane platform 11 of guide vane 300 (see FIGS. 1 and 2). In response to this bore 37 being subject to possible wear due, for example, to rotations of guide vane 300 according to the present invention about longitudinal axis 14 thereof (orthogonally to the drawing plane) and/or in response to thermal material expansions during operation, bore 37 of inner ring 7 may be or become displaced. Dashed circle 39 represents a maximum displacement of bore 37 as the result of wear.

Relative to previously described hook position 35 of slide plate 27, slide plate 27 may at least partially cover, respectively seal gap 41 between outer boundary edge 43 of guide vane platform 11 and of bore 37 and thereby at least partially prevent a leakage flow 25 (see FIG. 3).

In addition, FIG. 4*a* shows an access bore 45 that is configured in the bottom side (radially inner side) of guide vane platform 11. The function of access bore 45 is described in FIG. 4*b*.

Figure 4B:
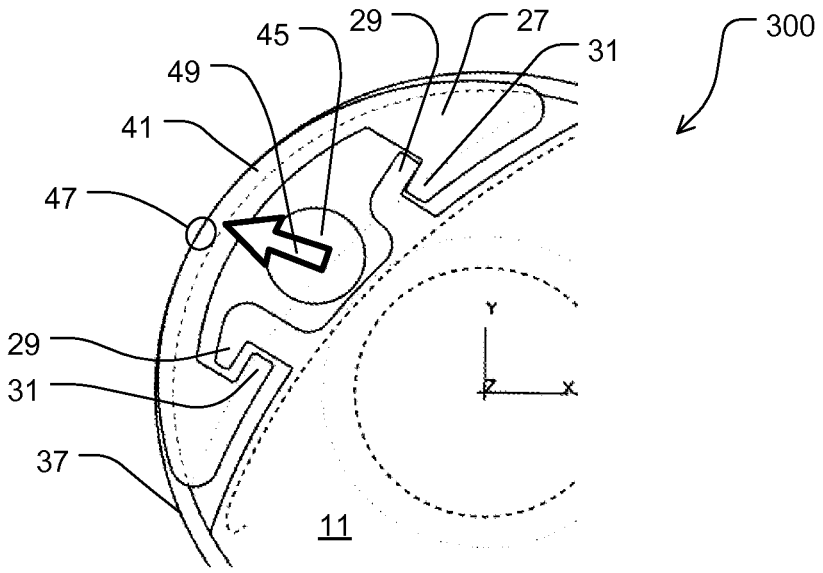

FIG. 4*b* shows slide plate 27 in a position that is displaced relative to the initial position (installation position) in which gap 41 is regionally covered or sealed by slide plate 27. This position may be referred to as nominal position (in the installed state and pressurized).

In region 47, slide plate 27 rests against bore 37 of inner ring 7. Offset 31 of slide plate 27, which is upwardly disposed in FIG. 4*b*, rests against upper stop hook 29. On the other hand, lower offset 31 does not rest against lower stop hook 29. This would at least be possible, however, in the case of a worn bore 39 (see FIG. 4*a*).

Slide plate 27 may be moved and shifted from the initial position (FIG. 4*a*) into the displaced position (FIG. 4*b*) by a flow that flows through access bore 45, respectively by the pressure force induced by this flow. Arrow 49 depicts the direction of the pressure force of this flow.

Figure 4C:
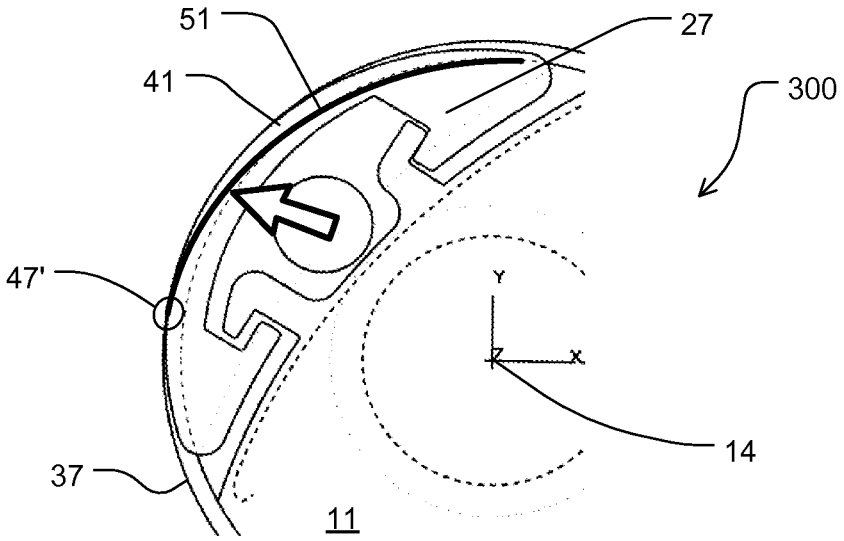

FIG. 4*c* shows an alternative, shifted contour 51 (or retraction of the contour) of slide plate 27. Due to displaced contour 51, abutting region 47' of slide plate 27 is likewise shifted at the bore of inner ring 7. In possible alternative contour 51 shown exemplarily here, abutting region 47' (or the point of contact) is downwardly displaced in FIG. 4*c*. Other contour shapes could displace abutting region 47' still further downwardly or further upwardly, for example.

The covered or sealed region of gap 41 between bore 37 (or worn bore 39) and the outer boundary edge of guide vane platform 43 is influenced by a displacement of abutting region 47'. This may be particularly relevant and advantageous when the intention is to cover the outflow region of leakage outflow 25 (see FIG. 3) as precisely as possible, for example, to selectively optimize efficiency. It is also possible to modify and influence the outflow region of leakage outflow 25 by the rotation of guide vane 300 according to the present invention about longitudinal axis 14 thereof. The rotation of guide vane 300 according to the present invention, respectively the position of guide vane profile 3 relative to the incident flow thereof may essentially depend on the flow conditions prevailing in the turbomachine, that are influenced, for example, by a full-load or partial-load operating state.

Figure 5A:
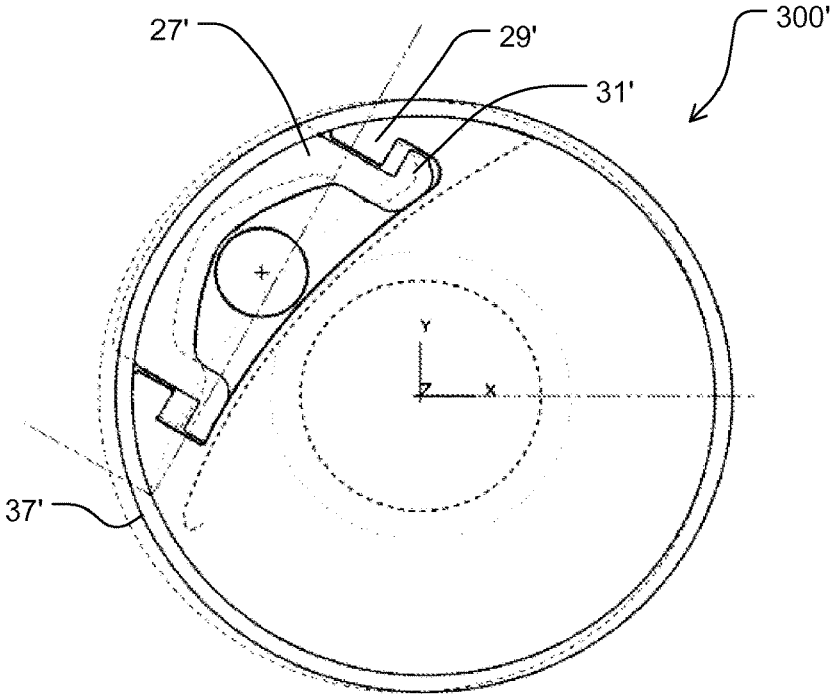
FIGS. 5*a, b* show a further guide vane according to the present invention.

FIG. 5*a* shows another guide vane 300' according to the present invention. Stop hooks 29' are displaced (or inverted) relative to the configuration from FIG. 4*a-c*. In correspondence with stop hooks 29', offsets 31' of slide plate 27' are likewise displaced. Slide plate 27' is configured in the initial or installation position.

Figure 5B:
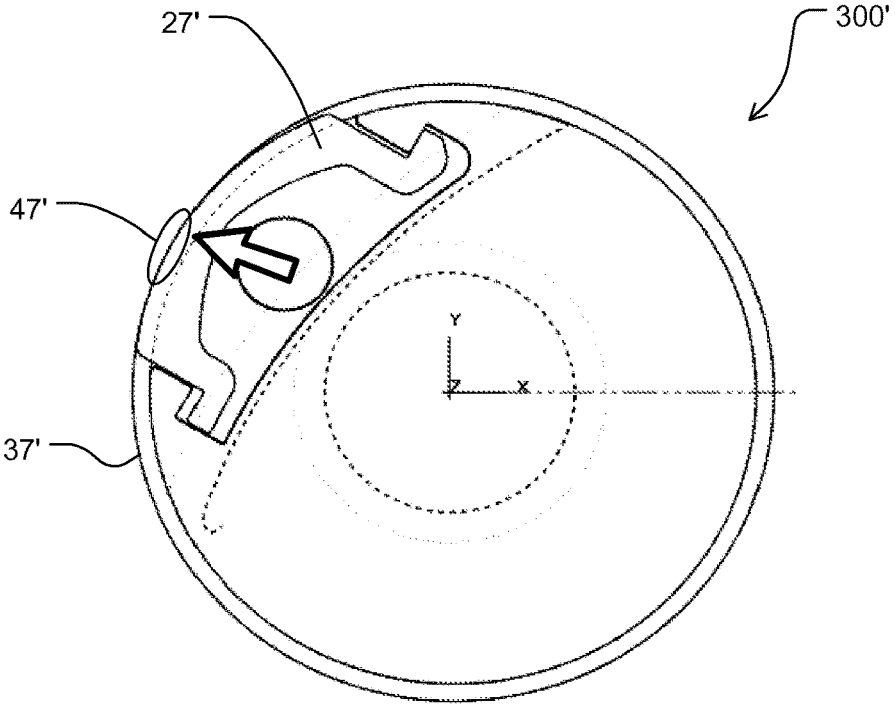

The remaining description of FIG. 4*a-c* holds analogously for FIG. 5*a*. FIG. 5*b* shows further guide vane 300' according to the present invention from FIG. 5*a* in a pressurized position (or nominal position). In region 47', slide plate 27' rests against bore 37'.

Figure 6A:
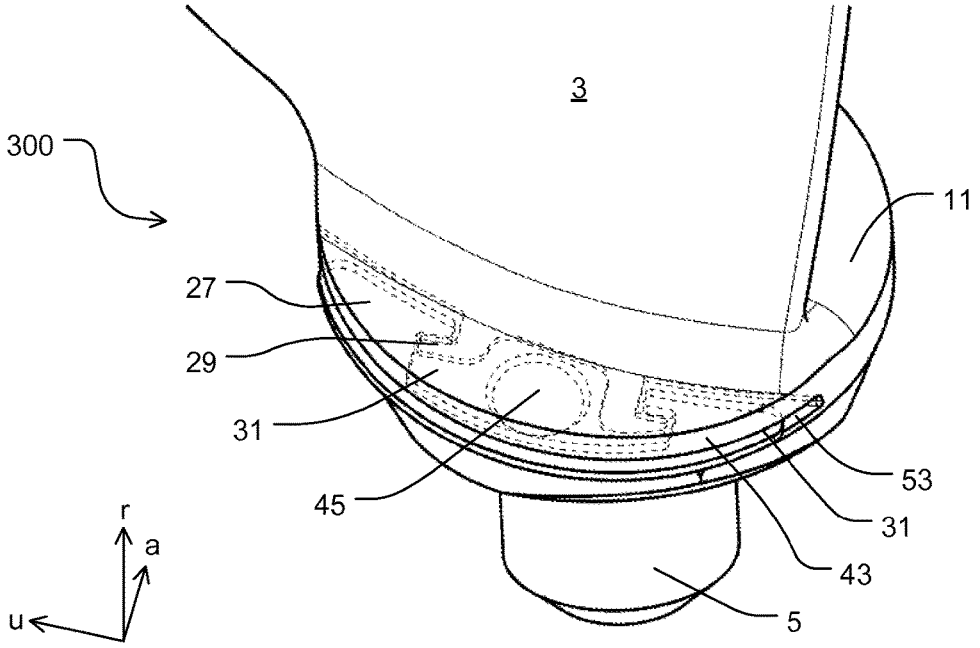
FIGS. 6*a, b* show the guide vanes according to the present invention from FIGS. 4*a* and 4*b* in a perspective view.

FIG. 6*a* shows guide vane 300 according to the present invention from FIG. 4*a* and FIG. 4*b* in a perspective view.

In this view, a slot 53 is discernible in guide vane platform 11 in which slide plate 27 is movably configured (in the plane having axial direction a and circumferential direction u). In the installation position thereof, slide plate 27 is completely integrated in slot 53 and does not project beyond outer boundary edge 43 of guide vane platform 11.

Slide plate 27 may project out of slot 53, but not fall out, particularly in a pressurized position of slide plate 27, in which a pressure force acts from the radially inner side of guide vane platform 11 (covered underneath guide vane platform 11 in FIG. 6*a*). Slide plate 27 is prevented from falling out by stop hooks 29 on guide vane 300 and on offsets 31 at slide plate 27.

Figure 6B:
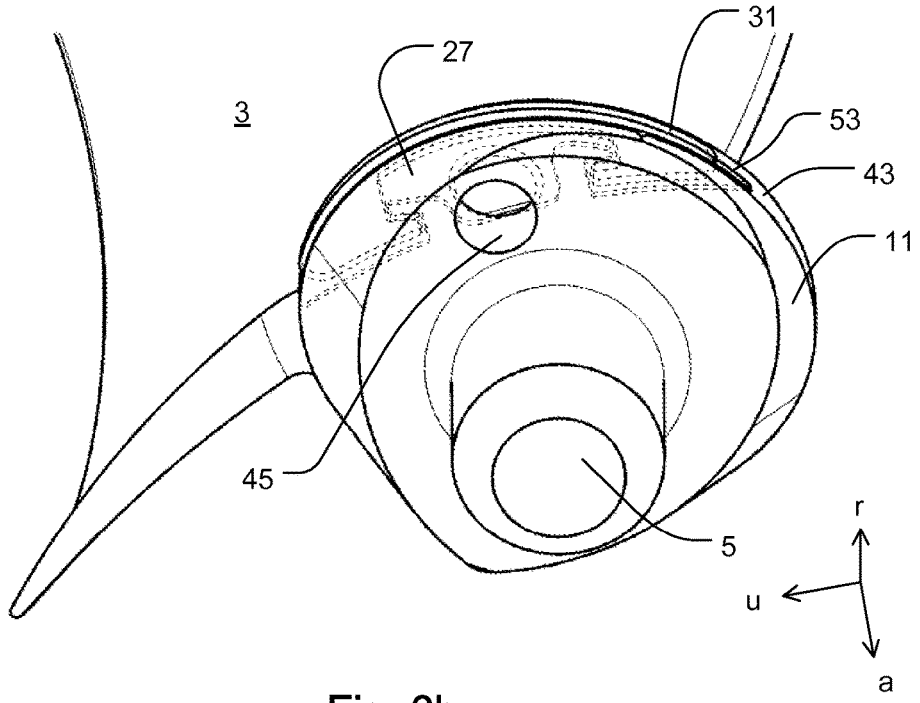

FIG. 6*b* shows guide vane 300 according to the present invention from FIG. 6*a* in a rotated perspective view from radially inwardly to radially outwardly.

In this view, open access bore 45 is directly visible.

Figure 7A:
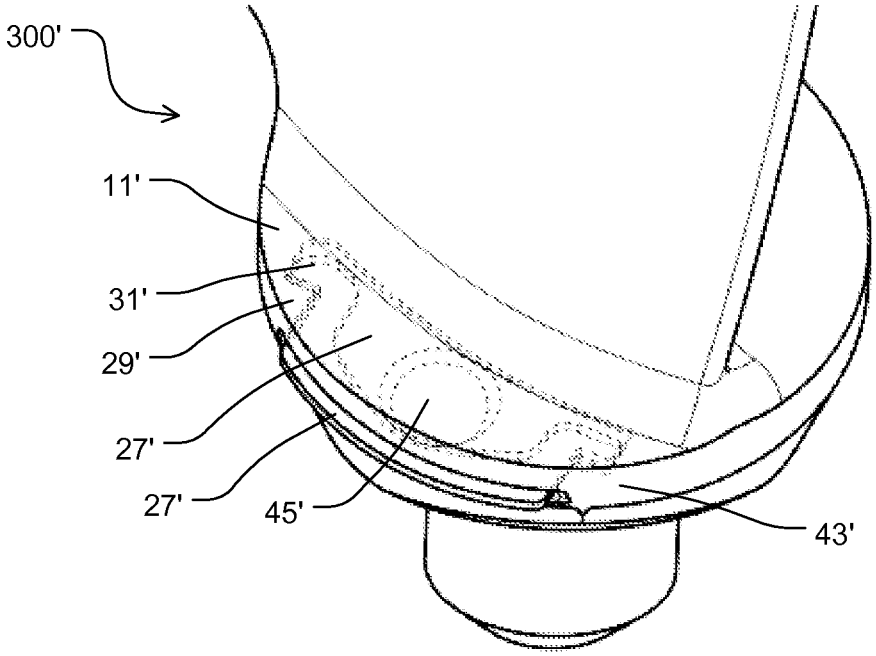
FIGS. 7*a, b* show the guide vanes according to the present invention from FIGS. 5*a* and 5*b* in a perspective view.

FIG. 7*a* shows guide vane 300' according to the present invention from FIG. 5*a* and FIG. 5*b* in a perspective view.

In comparison to guide vane 300 according to the present invention from FIG. 4*a*, 4*b*, 4*c* and from FIGS. 6*a* and 6*b*, stop hook 29' at guide vane 300' is configured in the outer region of guide vane platform 11'. On the other hand, offset 31' of slide plate 27' is configured further inwardly.

Slide plate 27' projects beyond outer boundary edge 43' of guide vane platform 11'. This is particularly the case when slide plate 27' is pressurized in the installed state of guide vanes 300', i.e., slide plate 27' has been moved outwardly or shifted in response to a pressurizing throughflow (in particular, of a leakage flow) through access bore 45'.

Figure 7B:
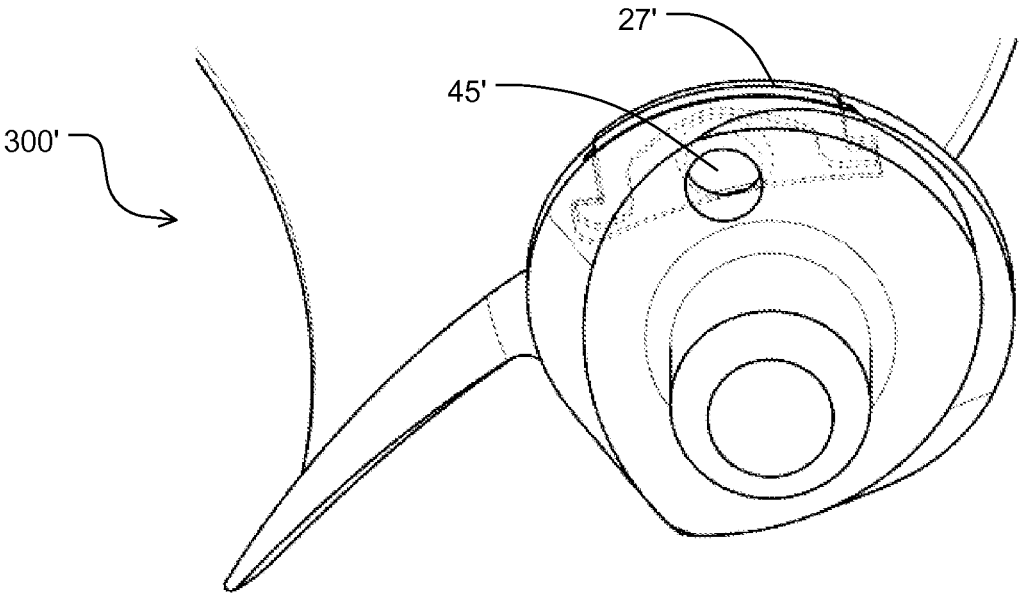

FIG. 7*b* shows guide vane 300' according to the present invention from FIG. 7*a* in a rotated perspective view from radially inwardly to radially outwardly, including open access bore 45'.

Figure 8A:
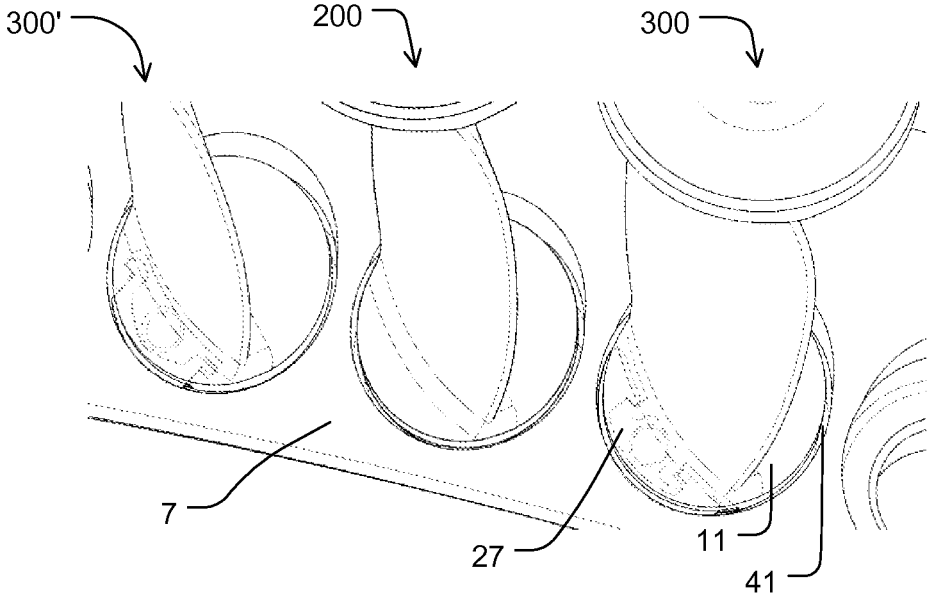
FIGS. 8*a, b, c* show the guide vanes according to the present invention from FIGS. 4*a*, 4*b*, 6*a* and 6*b* having different adjustment angles for the guide vanes.

FIG. 8*a* shows three different specific embodiments of guide vanes 200, 300, 300' in an inner ring 7 in perspective views.

Guide vane 200 corresponds to the related art and was described in FIGS. 1, 2 and 3.

Guide vane 300 according to the present invention was described in FIGS. 4*a-c* and 6*a, b*; guide vane 300' according to the present invention was described in FIG. 5*a, b* and FIG. 7*a, b*.

Figure 8B:
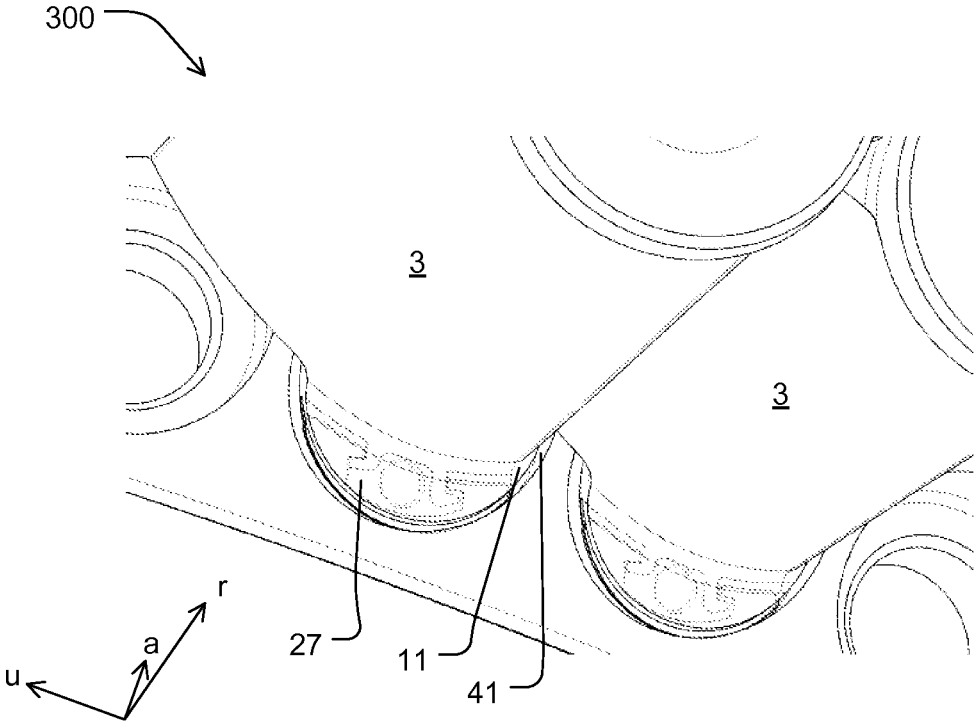

FIG. 8*b* shows two guide vanes 300 according to the present invention in a positioning angle that is changed relative to FIG. 8*a*. Positioning angle signifies the angle of guide vane 300 about the longitudinal axis thereof. In comparison to FIG. 8*a*, profiles 3 of guide vanes 300 are oriented further in circumferential direction u in FIG. 8*b*. This modified positioning angle influences slide plate 27. In FIG. 8*a*, slide plate 27 of guide vane 300 moves in a direction obliquely to circumferential direction u and axial direction a to allow slide plate 27 to seal gap 41 (the leakage flow passing therethrough). In FIG. 8*b*, slide plate 27 is oriented in a direction virtually parallel to axial direction a in order to seal gap 41.

Figure 8C:
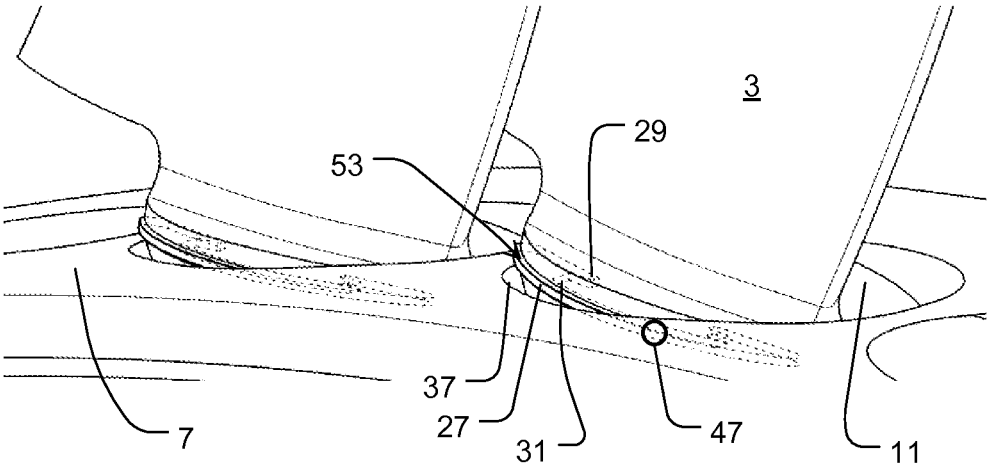

FIG. 8*c* shows the configuration of guide vanes 300 according to the present invention from FIG. 8*b* in another perspective view.

Depending on the positioning angle of guide vanes 300, at least one region of guide vane platform 11 may project beyond the surface of inner ring 7. Slide plate 27, slot 53, stop hook 29 and offset 31 were structurally designed to largely rule out any jamming and ensure the functioning of slide plate 27. This is achieved, in particular, by providing stop hooks 29 in different design variants, such as, for example, positioning of the center of rotation of stop hooks 33 (see FIG. 4*a*).

In addition, the shape of the region of slide plate 27 that projects beyond outer boundary edge 43 of guide vane platform 11, and/or the positioning (depth) of slide plate 27 along with corresponding contact portion 47 (see FIG. 4*b* and FIG. 4*c*) may be configured at the bore of inner ring 37 to allow this contact portion 47 to still come to be even in the context of maximum adjustment angles and maximum wear of the bore of inner ring 37 (offsetting of the inner ring-bore).

Figure 9A:
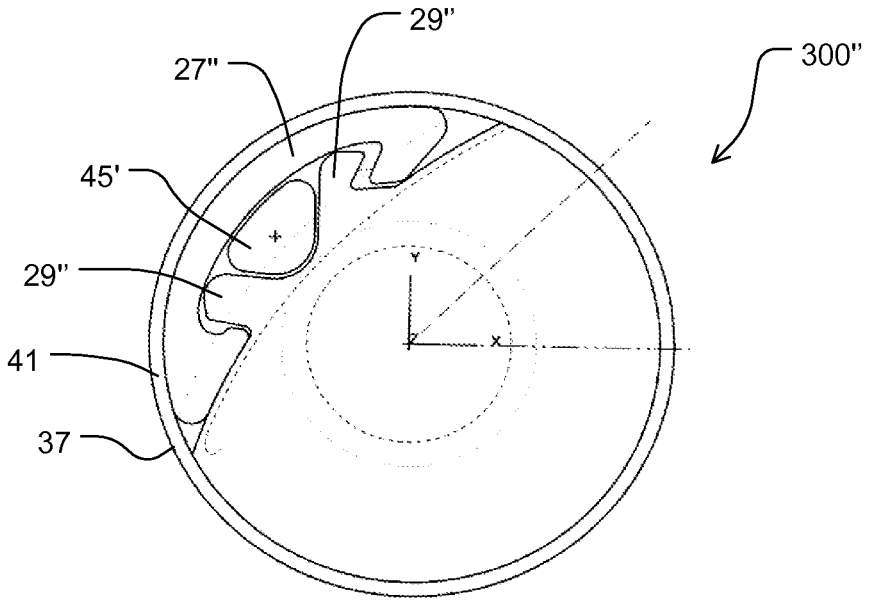
FIGS. 9*a, b* show a guide vane according to the present invention including a further sealing device and two further stop hooks.

FIG. 9*a* shows another guide vane 300" according to the present invention having a further sealing device 27" and two further stop hooks 29" in an installation position relative to the inner ring assembly. In this installation position, guide vane 300" may be inserted into or mounted in an inner ring 7 (see FIG. 8*a* through 8*c*). In FIG. 9*a*, inner ring 7 is indicated by circle 37 or bore 37.

Further sealing device 27" is configured as slide plate 27". Both slide plate 27", as well as two further stop hooks 29" are structurally designed to allow slide plate 27", as a resilient element, to be slid onto or over stop hooks 29" and installed. This assembly operation is described in greater detail in FIG. 11*a* through 11*d*.

In contrast to the previously illustrated circular access bore 45 in FIG. 4 through 8, further access bore 45' features a rounded triangular shape. In comparison to the circular cross-sectional shape, this triangular cross-sectional shape is larger to allow the throughflow of fluid. Thus, the pressure force induced by this flow may advantageously move slide plate 27" more simply and readily in the operating state or in the specific application and at least partially close gap 41 to inner ring 7. This makes it possible to at least partially reduce previously discussed leakage flow 25.

Figure 9B:
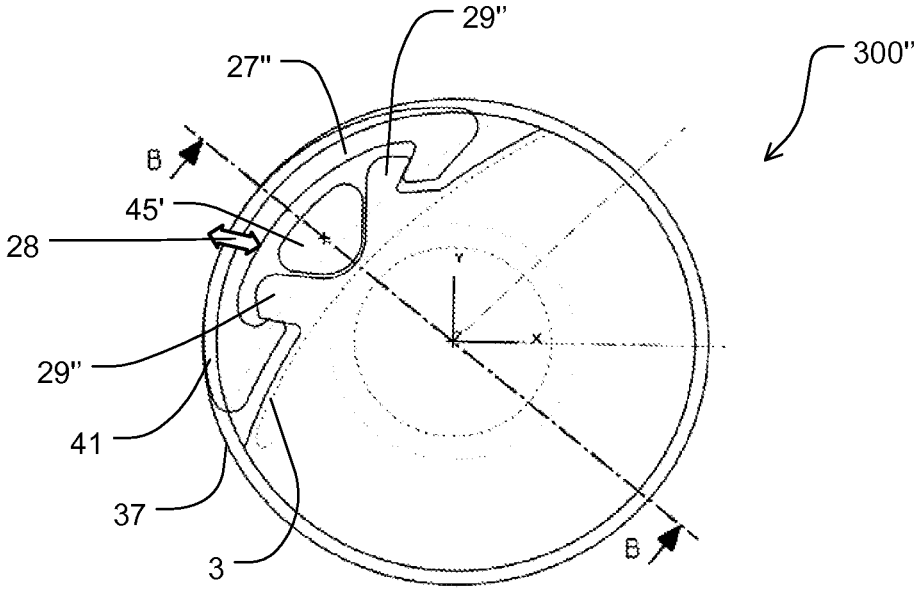

FIG. 9*b* shows guide vane 300" according to the present invention from FIG. 9*a* in the closed state. In contrast to the open or installation state from FIG. 9*a*, in the closed state, slide 27" seals gap 41 in certain regions. In terms of structural design, this region is selected to allow a gap flow 25 or leakage flow 25 (see FIG. 2) to be at least partially reduced on the suction side of vane profile 3.

In response to the pressure force of the flow, slide 27" is moved through access bore 45' toward displacement path 28 to the edge of bore 37 of inner ring 7.

Slide 27" rests by both offsets 31" against stop hooks 29".

The configuration of this guide vane 300" corresponds to a variant that does not have any center of rotation 33 (see FIG. 4*a*).

Figure 10A:
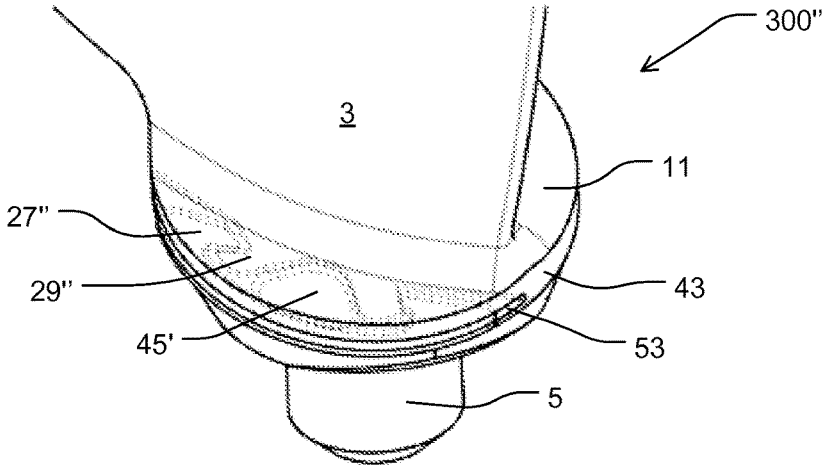
FIGS. 10*a, b, c* show the guide vanes according to the present invention from FIG. 9*b* in perspective views and as a sectional representation.
Figure 10B:
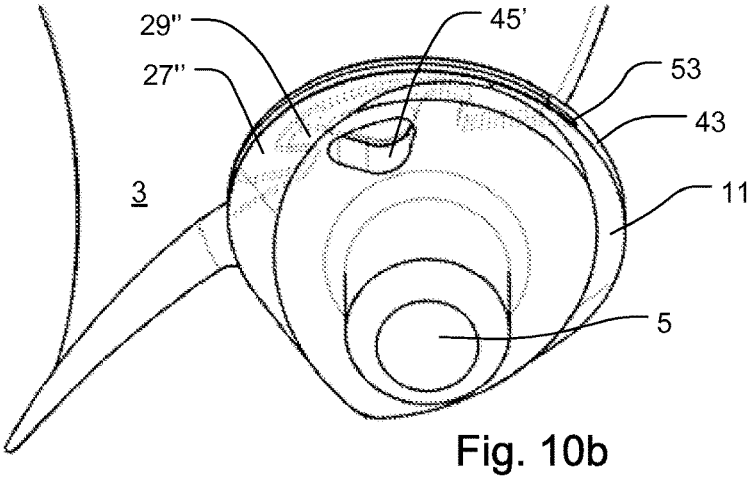
Figure 10C:
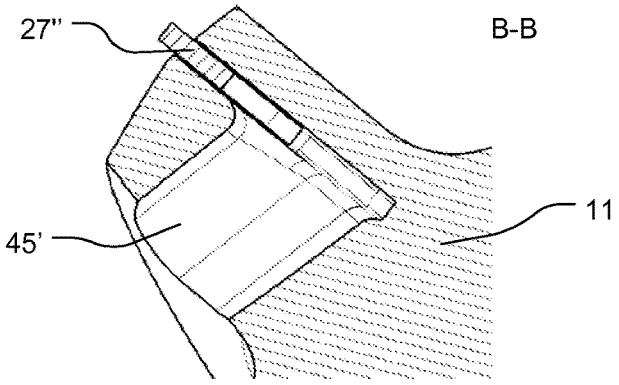

Sectional plane B-B is shown in FIG. 10*c*.

FIG. 10*a* shows guide vane 300" according to the present invention from FIG. 9*b* in a perspective view. The discussion of FIG. 6*a* holds analogously for slide 27", stop hook 29", etc.

FIG. 10*b* shows guide vane 300" according to the present invention from FIG. 9*b* in a further perspective view. The discussion pertaining to FIG. 6*b* holds here analogously for the modified design of slide plate 27", for stop hook 29", and for other modified regions.

FIG. 10*c* shows guide vane 300" according to the present invention from FIG. 9*b* as a sectional representation B-B. Clearly discernible in this view is access bore 45' that is used for moving slide plate 27" within guide vane platform 11.

Figure 11A:
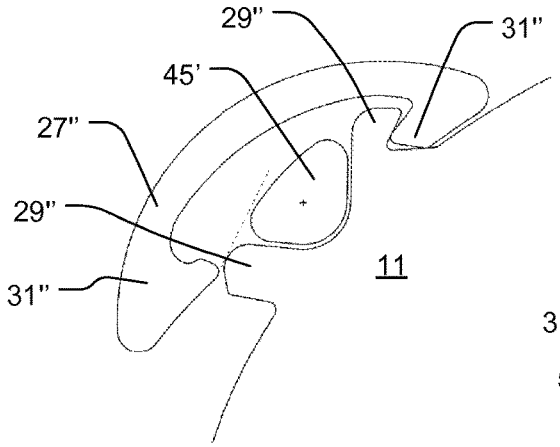
FIGS. 11*a, b, c, d* show the steps for installing the slide plate from FIG. 9*a*.

FIG. 11*a* shows the first step for mounting slide plate 27" on stop hooks 29" of guide vane platform 11" of guide vane 300" according to the present invention.

Slide plate 27" is first placed by upper offset 31" thereof on upper stop hook 29" and hooked in. Lower offset 31" is subsequently placed or put on lower stop hook 29".

Figure 11B:
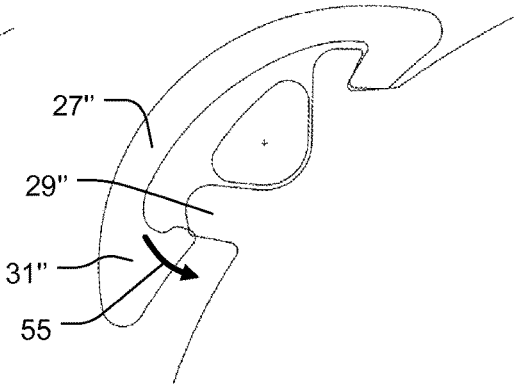

FIG. 11*b* shows the second step for mounting slide plate 27" on guide vane platform 11". Slide plate 27" is moved or pressed in arrow direction 55, allowing lower offset 31" to be slid over stop hook 29" by an elastic deformation of slide plate 27". This procedure may be described as "clipping in."

Figure 11C:
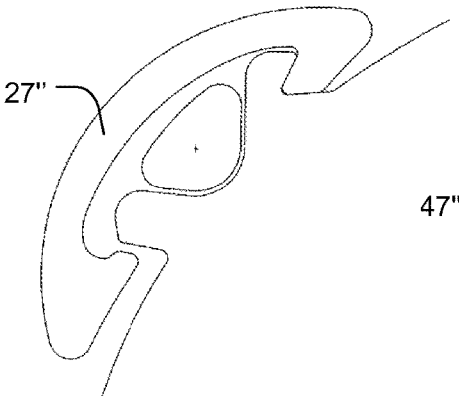

FIG. 11*c* shows the third step for mounting slide plate 27". Slide plate 27" is in the installed position, and guide vane 300" may be slid onto inner ring 7 or be joined thereto (see FIG. 8*a* through 8*c*). In this installation position, gap 41 is not yet closed.

Figure 11D:
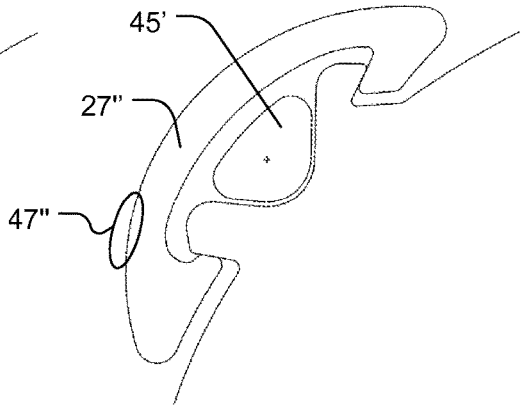

FIG. 11*d* shows the fourth step for mounting slide plate 27". This step is no longer included in the actual installation. In this step, pressure is applied through access bore 45' (see FIG. 10*c*) for moving and sealing gap 41, at least in a partial region of gap 41 (see FIG. 9*b*). Slide plate 27" subsequently rests against bore 37 of inner ring 7. This region is shown as abutting region 47" of slide plate 27".

The position of slide plate 27" may be referred to as sealing position.

LIST OF REFERENCE NUMERALS

100 stator, stator rim
200 guide vane according to the related art
300 guide vane according to the present invention
a axial; axial direction
r radial; radial direction
u circumferential direction
1 outer pivot pin
3 guide vane profile
5 pin; pivot pin
7 inner ring
9 seal carrier
11, 11' guide vane platform
13 bushing
14 longitudinal axis of the guide vane
15 bore
17 securing pin
19 abradable seal
21 sealing peaks
23 shaft
25 leakage flow
27, 27' sealing device; slide plate
28 displacement path
29, 29' stop hook on the guide vane
30 rotation angle
31, 31' offset of the slide plate
33 center of rotation of the stop hooks
35 hook position of the slide plate
37 circle; bore
39 worn bore
41 gap
43, 43' outer boundary edge of the guide vane platform
45 bore; access bore
47, 47' abutting region of the slide plate
49 direction of the pressure force of the flow through the access bore
51 alternative contour of the slide plate
53 slot
55 arrow direction

What is claimed:

1. A rotatable guide vane for a turbomachine, the guide vane comprising:

a sealing device at a radially inner end region of the guide vane for sealing leakage flows between the rotatable guide vane and an inner ring joined to the guide vane, the guide vane being rotatable in the inner ring;

the sealing device being movably configured relative to the guide vane, and the sealing device positionable in at least one open or in a closed configuration for sealing the leakage flows, the sealing device being movable between the open configuration and the closed configuration orthogonally to a longitudinal axis of the guide vane, wherein in the open configuration a cross section for the leakage flows is not or at least not completely sealed by the sealing device and in the closed configuration the cross section for the leakage flows is at least reduced by the dealing device.

2. The guide vane as recited in claim 1 further comprising at least one offset for limiting a displacement path or a rotation angle of the sealing device.

3. The guide vane as recited in claim 1 wherein the sealing device has at least one stop hook for limiting a displacement path or a rotation angle of the sealing device.

4. The guide vane as recited in claim 1 wherein the guide vane is rotatably mounted on the inner ring about the longitudinal axis of the guide vane.

5. The guide vane as recited in claim 1 wherein the sealing device is a plate.

6. The guide vane as recited in claim 1 wherein the sealing device is a slide plate.

7. The guide vane as recited in claim 1 wherein the sealing device has a bore for allowing throughflow of at least a portion of the leakage flow.

8. The guide vane as recited in claim 1 wherein the sealing device has at least two stop hooks, the stop hooks configurable asymmetrically in one displacement direction of the sealing device relative to a central axis of the sealing device.

9. The guide vane as recited in claim 1 further comprising at least two stop hooks, the stop hooks configurable asymmetrically in one displacement direction of the sealing device relative to a central axis of the sealing device.

10. The guide vane as recited in claim 1 wherein the sealing device is configurable in a pocket shape in a guide vane platform.

11. The guide vane as recited in claim 1 wherein the sealing device is produced using an additive manufacturing process.

12. The guide vane as recited in claim 1 wherein the guide vane is produced using an additive manufacturing process.

13. A stator comprising at least one guide vane as recited in claim 1.

14. A turbomachine having a stator as recited in claim 13, the turbomachine being a gas turbine or an aircraft engine.

15. The guide vane as recited in claim 1 wherein the guide vane has a radially inner pin and bushing for connecting to the inner ring.

16. The guide vane as recited in claim 15 wherein the guide vane has a radially outer pivot pin.

17. The guide vane as recited in claim 1 wherein the radially inner end region includes a guide blade platform with an outer circular shape.

18. The guide vane as recited in claim 17 wherein the sealing device is a slide plate having a contour for contact with the inner ring, the contour having an arced shape.

19. A stator rim comprising a plurality of guide vanes, each guide vane being the guide vane as recited in claim 1, and the inner ring, each guide vane having a radially inner pivot pin connected to the inner ring.

20. The stator rim as recited in claim 19 wherein the inner ring is connected to an annular seal carrier carrying an abradable seal.

21. A guide vane for a turbomachine, the guide vane comprising:

a sealing device at a radially inner end region of the guide vane for sealing leakage flows between the guide vane and an inner ring joined to the guide vane the sealing device being movably configured relative to the guide vane, and the sealing device positionable in at least one open or in a closed configuration for sealing the leakage flows, the sealing device being movable orthogonally to a longitudinal axis of the guide vane;

wherein the radially inner end region includes a guide blade platform with an outer circular shape; and wherein the sealing device is a slide plate having a contour for contact with the inner ring, the contour having an arced shape.

* * * * *